US007578605B1

(12) United States Patent
Mullins et al.

(10) Patent No.: US 7,578,605 B1
(45) Date of Patent: Aug. 25, 2009

(54) LIGHT SHAPING REFLECTOR SYSTEM AND METHOD OF MANUFACTURE AND USE

(76) Inventors: Patrick Stuart Mullins, 1703 E. O St., Apt. E, Russellville, AR (US) 72801; Michael Raymond Bruck, 1876 Petit Jean Mountain Rd., Morrilton, AR (US) 72110

( * ) Notice: Subject to any disclaimer, the term of this patent is extended or adjusted under 35 U.S.C. 154(b) by 0 days.

(21) Appl. No.: 11/516,080

(22) Filed: Sep. 6, 2006

(51) Int. Cl.
*F21V 7/00* (2006.01)

(52) U.S. Cl. ..... 362/297; 362/296; 362/346

(58) Field of Classification Search ..... 362/297, 362/296, 346, 514, 517, 301–304, 298, 16–18, 362/290, 342, 343, 325, 296.1
See application file for complete search history.

(56) References Cited

U.S. PATENT DOCUMENTS 4,386,824 A 6/1983 Draper
4,409,646 A * 10/1983 Baliozian ..... 362/319
4,788,628 A * 11/1988 Farrall ..... 362/18
4,922,386 A * 5/1990 Bockeler et al. ..... 362/539
6,048,084 A 4/2000 Sedovic
6,318,886 B1 11/2001 Stopa
6,641,284 B2 11/2003 Stopa
6,854,865 B2 2/2005 Probst
2005/0007756 A1 * 1/2005 Yu et al. ..... 362/31
2006/0203493 A1 * 9/2006 Brower et al. ..... 362/297

* cited by examiner

*Primary Examiner*—Jacob Y Choi
*Assistant Examiner*—Robert May
(74) *Attorney, Agent, or Firm*—Mind Law Firm; Jeromye V. Sartain

(57) ABSTRACT

A reflector system having two-axis control through which beam collimation and wide-angle beam overlapping occur, and a method of manufacturing such a system through cutting flat reflective sheeting and forming the resultant flat parts into the three-dimensional reflectors that collect and shape the light from solid state LEDs, wherein each axis may be customized by changing the cutting and bending of the flat pieces.

9 Claims, 6 Drawing Sheets

Fig. 12
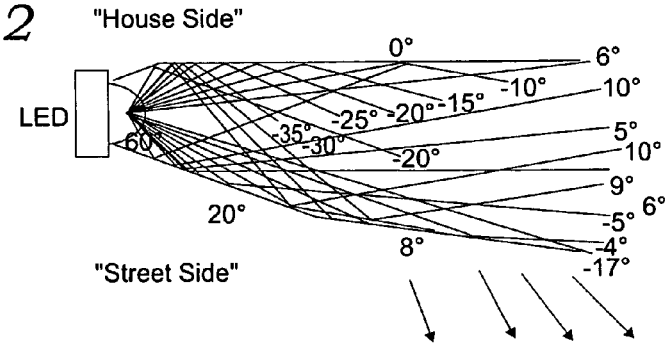
Fig. 13
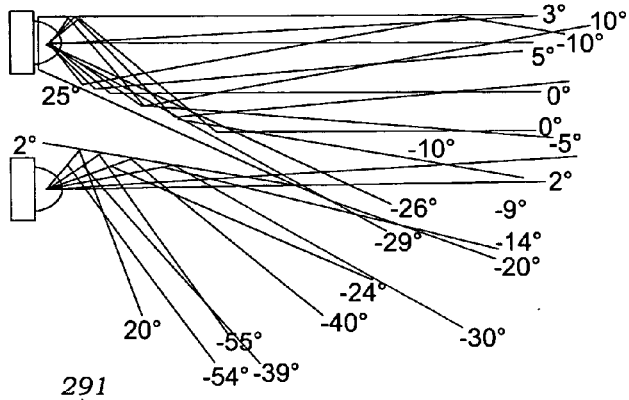
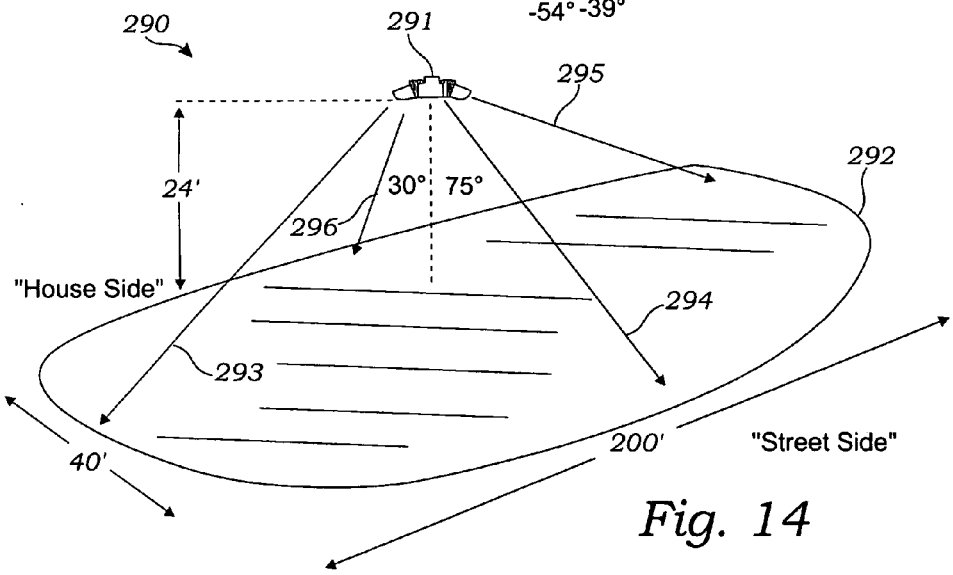
Fig. 14

LIGHT SHAPING REFLECTOR SYSTEM AND METHOD OF MANUFACTURE AND USE

RELATED APPLICATIONS

This application claims priority and is entitled to the filing date of U.S. Provisional Application Ser. No. 60/714,218 filed Sep. 3, 2005, and entitled "LIGHT SHAPING REFLECTOR SYSTEM FOR LIGHT EMITTING DIODES." The contents of the aforementioned application are incorporated by reference herein.

INCORPORATION BY REFERENCE

Applicants hereby incorporate herein by reference any and all U.S. patents and U.S. patent applications cited or referred to in this application.

BACKGROUND OF THE INVENTION

1. Field of the Invention

Aspects of this invention relate generally to systems for shaping light emission patterns of solid state lighting units or assemblies, and more particularly to systems for shaping the light emitted from Light Emitting Diodes ("LEDs") used in indoor or outdoor lighting units.

2. Description of Related Art

LEDs are now available in high power packages that provide high lumen output from a single source. In the context of indoor and outdoor lighting, one challenge in connection with the use of such "high-output LEDs" is collecting and reshaping the light to efficiently illuminate the areas and shapes required by industry lighting standards and the application. These high-output devices have a much larger light emitting area that requires attention to optical design. And unlike previous smaller LEDs that generally have integral refractive optics, high-output LEDs have large area wide-angle light emissions that almost always require secondary optics. High-output LEDs are also known to produce considerable heat and so must be mounted to a thermally dissipating structure to ensure maximum life.

The thermal and optical requirements of high-output LEDs require mutual consideration, and while thermally mounted, the optical solution must capture or otherwise use or control light emissions from 360-degrees around the LED's forward hemisphere and redirect the light toward the axis of the desired illumination pattern. A common illumination pattern required of such a lighting unit usually requires that it be mounted midway in a rectangular lighting pattern that requires the most significant percentage of the light from the LEDs to be directed away from the lighting unit. Additionally, for luminous uniformity from streetlight luminaires or parking garage luminaires, for example, the application can require twenty times more light directed toward the far field than the amount of light required directly beneath the luminaire. Applicants note that as used throughout, the term "luminaire" is to be understood broadly as being any complete lighting unit.

Conventional optics of the prior art commonly have a combination of lenses and reflectors to collect the various angles of light emitted from the LED in order to shape its output into appropriate patterns. Refractive designs for wide angles or multiple angles or sharp bending will typically suffer losses due to internal reflections within the refractive lens.

Each LED can require different optical solutions or dedicated optics for each application. For example, one industry standard for a streetlight luminaire requires a lighted swath of about 30-feet by 200-feet with the luminaire mounted 24-feet high near the center of that pattern. Additionally, an interior parking garage luminaire must light a swath of about 20-feet by 70-feet from a ceiling mounted luminaire only 8-feet high. The garage luminaire must also light the walls and ceiling, thus it must have considerably different optics than a streetlight luminaire.

The demand for LEDs of all kinds for illumination has created a multitude of applications, each requiring special optical shaping of the LED light output pattern. It is known that LED manufacturers are getting more light output with phosphor deposition and optical techniques that don't necessarily conform to true Lambertian or standard emission patterns, which can challenge or obsolete existing optics already set by LED integrators. A phenomenon created by some manufacturers with white LEDs occurs with their radial phosphor deposition at the LED chip, thereby producing more than one correlated color temperature ("CCT") emission in the spatial radiation pattern of the same LED.

Mass production of a molded optical solution, whether the system is optically refractive with an injection-molded lens or reflective with a deposited metalized finish on a molded substrate, requires intricate tooling and a highly polished mold. Such tools, though capable of mass production, are relatively expensive. Alternately, rapid prototyping methods through which a single part may be fabricated, though capable of smaller quantity production, ultimately cost even many times more than that of a mass production part while still requiring polishing. Either process can take several months or more to complete.

Again, each LED illumination product may require dedicated optical solutions for each application. For example, one industry standard for a streetlight luminaire requires a lighted swath of at least 40-feet by 200-feet with the luminaire mounted 24-feet high and situated asymmetrically or off-center of that pattern, or asymmetrical beam shaping. While asymmetrical optics may also be accomplished in molded refractive or reflective parts by adding or removing curvature or angle on a side of the mold, however, this does cause other complications as known in the art: (1) each half of the illumination task of the streetlight requires a different or mirror image mold, likely to require additional financial investment as well, and (2) draft angles and often necessarily symmetrical mold geometry can complicate some asymmetrical parts fabricated with a conventional release mold without special gates or slides, potentially adding further cost and delay to mold fabrication. Furthermore, LED integrators often mix colors of LEDs to affect different CCT, which can be problematic since LED family characteristics vary differently with time and environment.

In the prior art, U.S. patent application Ser. No. 11/085,891 by Applicant Patrick Mullins teaches a technique with a reflector system that uniformly illuminates those areas nearer to the luminaire at luminance levels inversely proportionate to those levels farther away. In U.S. Pat. No. 6,641,284 to Stopa et al., a "linear parabolic" shaped reflector is disclosed having no side lobe reflectors. In U.S. Pat. No. 6,318,886 to Stopa et al., there is disclosed a rectangular array of LEDs, each in a "frustoconical" reflector involving an array of circular light sources that can concentrate the LED light into a group of circular shapes proportionally similar to the shape of the array itself. U.S. Pat. Nos. 4,386,824 to Draper and 6,048,084 to Sedovic et al. disclose a rectangular reflector shape as a means to project light in a spot or flood application. U.S. Pat. No. 6,854,865 to Probst et al. discloses a "deep dish" parabola for a spot effect.

Aspects of the present invention are then directed to one or more features including but not limited to: (1) affixing the LEDs to a heat dissipating structure for proper cooling to maximize LED life; (2) shaping a reflector system into a rectangular or other shape emission pattern to match illumination requirements so as not to waste illumination in circular "spot" patterns; (3) providing a means to align a portion of the LEDs with an appropriate reflector such that segments of maximum candela light rays around the particular portion of the LEDs are captured and amplified or collimated directly to the far field illumination target; (4) capturing the remaining wide angle light from the aligned portion of LEDs to redirect and shape the light into the appropriate illumination pattern; (5) applying an additional portion of LEDs with their own unique optics to light an area beneath the luminaire and light a full area extending between the luminaire and the aforementioned far field; (6) making an illumination unit that is suitably modular such that opposed segments of a required lighting pattern can be illuminated by adjoining opposing modules, and patterns requiring only a segment of illumination can be illuminated by a single lighting module; (7) fabricating an optical reflector system by laser-cutting, water-jet-cutting, die-cutting or other cutting technique of flat metal or poly reflective (greater than 98% reflective) sheeting material to form and shape into a lens reflector, be it rectangular, circular or any other shape; (8) extracting or dissecting the LED angular output to recombine color temperatures and to match illumination requirements of the application; (9) assembling the formed part with tabs or vanes interlocking within slots that are self supporting and locking, utilizing designated tabs to bend or lock and eliminate additional fasteners; and (10) supporting asymmetrical part shaping without the need for relatively costly duplication or reverse molds or the like.

The prior art described above teaches various shaped reflectors formed from various materials and manufacturing methods, but does not teach a reflector system having two-axis control through which beam collimation and wide-angle beam overlapping occur or a method of manufacturing such a system through cutting flat reflective sheeting via laser, water-jet, die, or other such technique to form the resultant flat parts into the three-dimensional reflectors that collect and shape light from solid state LEDs, wherein each axis may be customized by changing only the laser, water-jet, die or other such cutting, bending, or shaping of the flat pieces. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention are directed to light sculpting and beam shaping for an individual LED or for a plurality of LED light sources while affixed to heat sinks or circuit boards. In an exemplary embodiment, the resulting reflector aligns approximately one-half of its light source, hereinafter referred to as "upper LEDs," within rectangular multi-angle reflectors to collimate or amplify one axis of those light rays that follow or approximate the angles of maximum candela in order to maximize light projection toward the farthest illumination areas of the target. In the case of a single LED, the reflector dissects and directs approximately one-half of the light source. The multiple angles in each of four sides of the exemplary reflector will collect nearly all remaining non-collimated light rays from the upper light source and will shape and redirect this light toward the areas within and adjacent the specified far field points to fill the subject area with luminance. The remaining approximately one-half of the light source, hereinafter referred to as "lower LEDs," may be directed to illuminate targets beneath and near the luminaire, without refraction, and follow the selected cut-off angles of the reflector that is positioned above the "lower LEDs." Accordingly, aspects of the reflector of the present invention allow the "lower LEDs" to directly illuminate nearby areas and, in aligning the optical axis of the "lower LEDs" with the same optical axis of the "upper LEDs," to capture at least four sides of the upper LED light rays for far field targets, whereby using off-axis rays with near targets allows an even greater brightness toward the distant target to be achieved.

Further aspects of the present invention teach a reflector system that conforms LED light emissions to a plurality of standards by substitution of only a few parts. Those skilled in the art will appreciate that various illumination standards may be met by changing a segment of a reflector angle or dimension. Aspects of the reflector system of the present invention can control or "cut off" multiple axis emissions from one LED or from a plurality of LEDs by moving the reflective angle and position relative to the LED. The reflector is sufficiently small to enable close proximity of high-output LEDs within an array, and by substituting different vanes, a large number of beam variations and shapes are possible. As such, the reflector system of the present invention can be adapted to numerous lighting standards by changing only the size and position of universal, simple and economical parts that are used in a plurality of product styles.

Aspects of the exemplary reflector system of the present invention further allow collimation or amplifying for light projection without the use of refraction lenses. As such, the LED lighting system may be encased beneath a single optically clear non-refracting window. It is known that the absence of refractive lenses in the window will yield higher optical efficiency and permit the same production window to be used with all like products regardless of their variations in light pattern distribution.

In a further aspect of the invention, the reflector provides two-axis control through which beam collimation and wide-angle beam overlapping occur by design to combine wide angle light rays that can be a different correlated color temperature ("CCT") than on-axis rays of that same LED. Accordingly, aspects of the present invention allow for the adjustment of color temperature by blending the various color temperatures from the same LED without the need to externally mix LED families.

Yet further aspects of the light shaping reflector system and method of the present invention provide for the customization of each axis of the reflector by changing only the laser-, water-jet-, die- or other such cutting of the flat pieces of reflective material from which the reflector is ultimately formed and/or by changing the subsequent bending and forming steps applied to the flat pieces. Those skilled in the art will appreciate that laser, water-jet, die-cutting and other such fabrication methods taught by the present invention can quickly provide optical solutions in which there is no significant difference between prototype and production grade optical quality. Further, laser- and water-jet-cutting methods particularly are known to be fractions of the cost, waste less material and be more accurate than die-cut and other production methods.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings:

FIG. 12 is a schematic diagram illustrating the optical ray tracing of an exemplary reflector of the present invention;

FIG. 13 is a schematic diagram illustrating the optical ray tracing of an alternative exemplary reflector of the invention; and FIG. 14 is a schematic diagram illustrating the light distribution for an alternative exemplary reflector of the invention.

DETAILED DESCRIPTION OF THE INVENTION

The above described drawing figures illustrate aspects of the invention in at least one of its exemplary embodiments, which are further defined in detail in the following description.

Figure 1A:
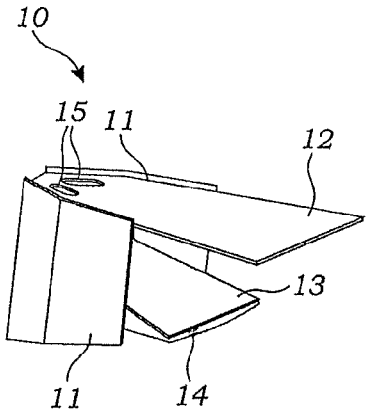
FIG. 1A is a right perspective view of an exemplary reflector of the present invention.
Figure 1B:
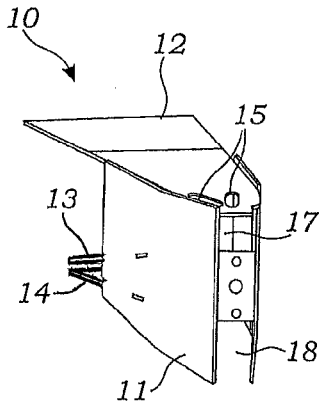
FIG. 1B is a rear perspective view thereof.
Figure 1C:
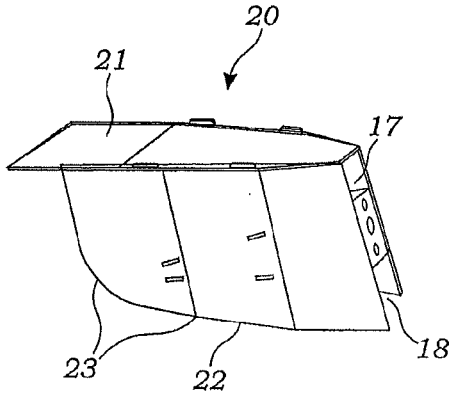
FIG. 1C is left perspective view of an alternative exemplary reflector of the invention.
Figure 2:
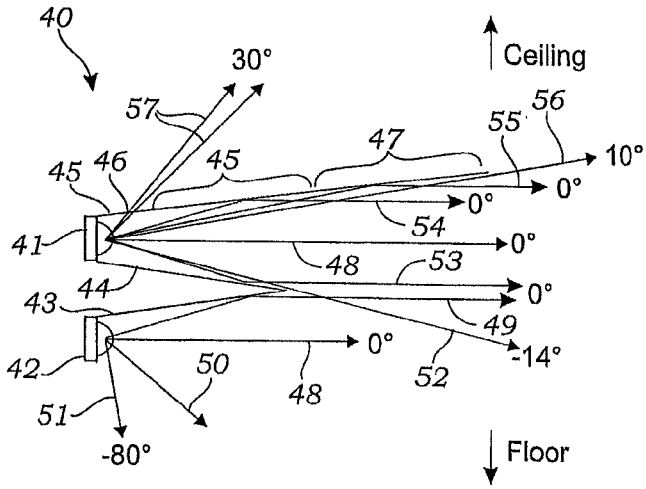
FIG. 2 is a schematic diagram of the side view of light rays in an exemplary reflector of the invention.

Turning first to FIGS. 1A-1C, there are shown exemplary embodiments of the reflector of the present invention. In FIGS. 1A and 1B, an exemplary parking garage reflector 10 is shown from the right and the rear, respectively, and in FIG. 1C, a side perspective view of a streetlight reflector 20 is shown. Referring to FIG. 1A there are shown side vanes 11 that wrap around a top vane 12, an upper intermediate vane 13 and a spaced apart lower intermediate vane 14 to form the reflector 10. The upper slots 15 formed in the top vane 12 allow some light to pass upward from at least the upper LED 41 (FIG. 2) toward a ceiling (not shown), more about which is explained below. In FIG. 1B of the rear of the reflector assembly 10, there is again shown the side vanes 11, which can now be seen as having a space therebetween in which are formed a cutout 17 for the upper LED 41 (FIG. 2) and a cutout 18 for the lower LED 42 (FIG. 2). Turning now to FIG. 1C, there is shown a streetlight reflector assembly 20 having side vanes 22 that wrap around a top vane 21. In the streetlight context, it is noted that the top vane 21 typically would not have slots for allowing "uplight." The upper LED cutout 17 and lower LED cutout 18 are again shown in FIG. 1C in the context of the streetlight reflector 20 for LED positioning, more about which is said below. As will also be understood more fully from the below discussion on use of the reflectors of the present invention, from FIGS. 1A-1C it is illustrated that the streetlight reflector side vanes 22 have an extended forward vane 23 for sharper horizontal beam cutoff than that of the exemplary parking garage reflector side vane 11. It will be appreciated by those skilled in the art that while particular configurations of the exemplary parking garage reflector 10 and streetlight reflector 20 have been shown and described, the invention is not so limited. Rather, numerous other configurations of such reflectors are possible in accordance with the principles of the present invention.

Referring now to FIG. 2, there is shown a schematic diagram of an LED assembly 40 having a vertically positioned upper LED 41 and an offset lower LED 42 positioned relative to each of four horizontal vanes 43, 44, 45, 47 positioned at varying angles within the reflector. For purposes of illustration only, FIG. 2 depicts the more significant light rays to show relative position on an illuminated target area. The reflector vane 43 is positioned to set an upward cutoff of the lower LED 42 while being also set to an appropriate angle to capture specific angle rays of LED emission to collimate ray 49 toward the target at zero degrees. Also shown from the lower LED 42 is a direct ray 48 that also leaves at zero degrees. A ray 51 goes almost straight down at 80 degrees nearer to the rear or lower LED emission limit. Here it is shown that the lower LED 42 also sends light in a forward and downward direction as depicted with ray 50. Those skilled in the art will appreciate that numerous other rays not actually shown emit between ray 48 and ray 51 as illuminating a generally downward area beneath the LED reflector assembly 40.

The LED reflector unit 40 further includes a vane 44 beneath the upper LED 41 that sets a downward cutoff limit of 14-degrees as represented by ray 52 in this example, and vane 44 also is of such an angle to redirect and collimate ray 53 toward the target at zero degrees. Similarly, the upper vane 45 captures and redirects ray 54 at zero degrees toward the target, and an additional angle with reflector vane 47 redirects yet another ray 55 at zero degrees toward the target. The upper LED 41 naturally has a direct ray 48 toward the target at zero degrees just as lower LED 42. In the exemplary embodiment, a ray 56 approximately 10 degrees above horizontal approximates the upper LED emission limit. Through the exemplary embodiment it is shown that a focus at zero degrees has maximum light power by collimating a large number of rays nearly in parallel, with four distinct ray angles from the upper LED 41 and two distinct ray angles from the lower LED 42. It is noted that a plurality of rays as shown are collimated from both LEDs and secondary bends of either reflector vane 43 and vane 44 can derive additional collimated beams toward the target of greatest distance. It will be appreciated by those skilled in the art that all angles shown and described for the four vanes 43, 44, 45, 47 are merely exemplary and that numerous other angles in various combinations may be employed in such a reflector 40 of the present invention to achieve varying light emission as required for the particular context. The number and size and shape of the vanes themselves may also vary according to the context. Accordingly, those skilled in the art will understand that the numerous other configurations of the reflector are possible without departing from the spirit and scope of the present invention.

With continued reference to FIG. 2, once again, in the exemplary embodiment, reflector vane 47 sets the upper cutoff of upper LED 41 at 10 degrees as shown with ray 56. It also is shown that reflector vane 45 has uplight slots 46 to allow rays 57 to provide uplight illumination. The ray diagram of FIG. 2 is not to limit the scope and illustrates the light control flexibility within an exemplary embodiment, and it should be clear to those skilled in the art that variations in vane angles are made to adjust light emissions to suit particular application needs, where more or less ray angles can be collimated for an application. It should also be clear that FIG. 2 represents light rays spanning a vertical coverage and that, as illustrated, upper LED 41 spans an area of 24 degrees vertically and lower LED 42 spans the area from −80 degrees up through the −14 degrees covered by the upper LED 41. The reflector diagram for the LED assembly 40 thus represents the emission angles with the LEDs perpendicular to the floor. However, those skilled in the art will appreciate that the reflector can be rotated to align the zero axis with a specific target, for example, tilted down 15 degrees to align all zero rays with a floor-wall corner at 30-feet.

Figure 3A:
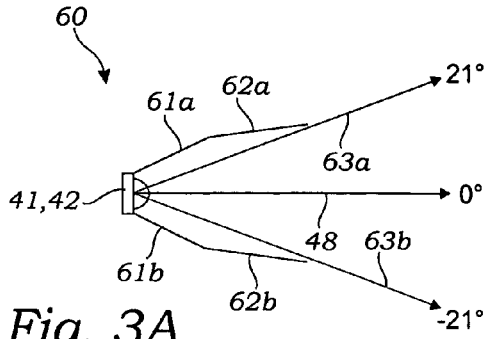
FIGS. 3A-3C are schematic diagrams of the top view of three levels of light rays in an alternative exemplary reflector of the invention.
Figure 3B:
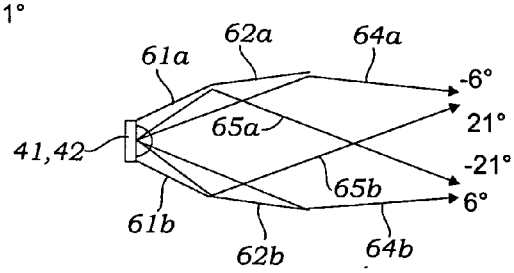
Figure 3C:
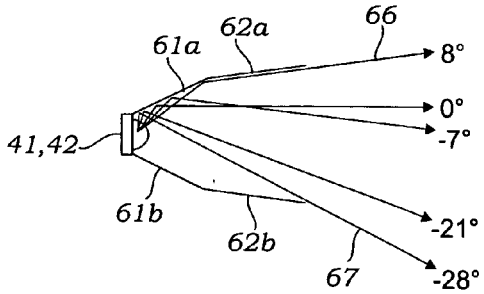

Turning now to FIGS. 3A-3C, there are shown top views of ray trace schematics of the exemplary embodiment reflector assembly 60 as viewed looking down into the top of the reflector, as if the top vane was transparent. Here, the upper and lower LEDs 41, 42 are shown within a reflector 60 having a first offset pair of side vanes 61*a*, 61*b* followed with a second, forward set of offset side vanes 62*a*, 62*b*. These same reflector side vane configurations and angles are true of each of the three schematics, where the LED emissions are separated into three groups of emissions angles for clarification, and those skilled in the art will appreciate that all three sets of light rays represented in the views of FIGS. 3A-3C represent concurrently emitted light rays during operation of the unit 60. The basis for the prescribed angles is derived from the exemplary parking garage lighting application wherein the luminaire must project light more than 10 feet left and more than 10 feet right onto a wall 30-feet distant. Given an objective of 11 feet:

ARC TAN 11/30=20 degrees left and 20 degrees right

Turning first to FIG. 3A, there is shown a segment of rays as non-reflected direct LED ray 63*a* through ray 63*b* with the direct zero degree ray 48 in between. FIG. 3B shows LED side lobe emissions as ray 64*a* and ray 65*a* reflected from reflector segment 62*a* and ray 64*b* and 65*b* reflected from reflector segment 62*b* beginning at the next wider angle past the ray 63*a*, 63*b* cutoff, perhaps 22-degrees, or just at the transition from the direct outer rays 63*a*, 63*b* shown in FIG. 3A at an angle of +/−21 degrees from horizontal. It can be seen that LED side lobe emissions are gathered and used to enhance the forward projection out to the +/−21 degree area. Similarly, as shown in FIG. 3C, a group of rays between and including ray 66 to ray 67 reflected from the inner side vane segment 61*a* further enhance projection and extend out to +/−28 degrees. Here in FIG. 3C, only one group of rays are shown from vane 61*a* for simplicity, and those skilled in the art will appreciate that vane 61*b* has the same set of rays as those shown from vane 61*a*, however at respective opposite angles from the rays reflected from side vane 61*a*. Once more, it will be appreciated by those skilled in the art that the angles and configurations of the side vanes are merely exemplary and that other orientations, size and numbers of the side vanes may be employed in a reflector unit according to the present invention without departing from its spirit and scope.

The schematic diagrams of FIG. 3 illustrate that nearly all horizontal light rays from the LED are concentrated within a 42 degree horizontal cone, with LED side lobe emissions folded back over the direct ray coverage area to amplify total target luminance within that specific dimension. In the exemplary application, each parking garage luminaire is mounted on approximately 20-foot centers with each luminaire projecting light side by side, and therefore it is to be understood that the additional 7 degrees of the 28-degree beams will overlap and fill in gaps between adjacent luminaires by approximately 6 feet overlap with an adjacent luminaire on each side:

TAN 28*30=16 feet left and 16 feet right

Figure 4:
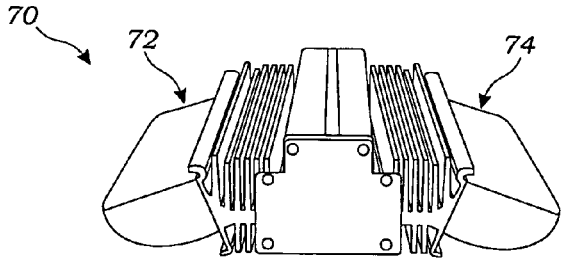
FIG. 4 is a perspective view of an exemplary luminaire of the invention.

Referring now to FIG. 4, there is shown a perspective view of an exemplary luminaire unit 70, with opposing sides 72, 74 of the unit each having one or more LED lighting units. Again, those skilled in the art will appreciate that the overall configuration of the luminaire unit 70 is only for illustration and that numerous other forms of the assembly involving various combinations of LED lighting units may be employed within the principles of the present invention.

Figure 5:
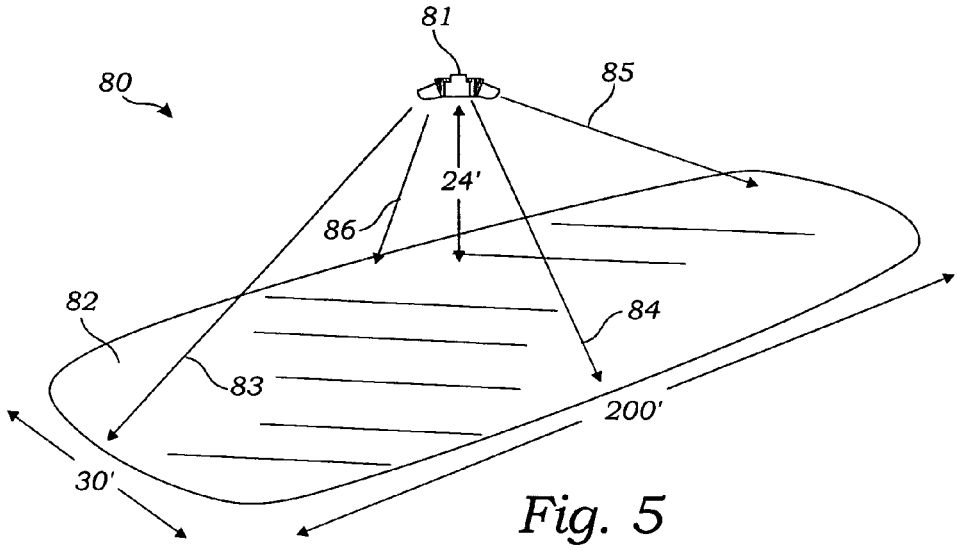
FIG. 5 is a schematic diagram illustrating the light distribution for an exemplary reflector of the invention.

In FIG. 5 there is shown a streetlight application generally denoted 80 with an exemplary lighting module of the present invention assembled into a luminaire 81 with light ray 83 and ray 85 extending longitudinally and with ray 84 and ray 86 extending in the transverse direction. In this exemplary embodiment, the footprint 82 may represent the ground or pavement, shown as having rough overall dimensions of 30'×200' when the luminaire is installed at a location approximately 24' above the target surface 82. Again, those skilled in the art will appreciate that such an application is merely for illustration as one of a large number of lighting applications for which a reflector unit according to the present invention could be adapted.

By way of further illustration, Table 1 below presents a comparison of four standard lighting applications and the field illumination patterns of such, including the streetlight at 24' off of the ground.

TABLE 1

| Application | Mounting Height | Transverse Distance | Transverse Angle (degrees) | Longitudinal Distance (from Luminaire) | Height of Far Field | Longitudinal Angle (degrees) |
|---|---|---|---|---|---|---|
| Parking Garage | 8' | 20' | 51 | 30' | 6' | 86 |
| Streetlight | 24' | 30' | 32 | 100' | 0' | 75 |
| Billboard | 1' to 4' | 5' | 76 | 10' | 0' | 84 |
| Wall Pack | 10 inches | 10' | 84 | 12' | 20' | 85 |

Upon review of Table 1, above, it is apparent that a parking garage reflector system provides wider area coverage than a streetlight reflector system and that other examples in Table 1 have unique distribution patterns of their own. Those skilled in the art will appreciate that while these examples depict only some of the variations in an exemplary embodiment, the angles shown can be adapted to many different standards and applications by the same basic lighting unit.

Figure 6:
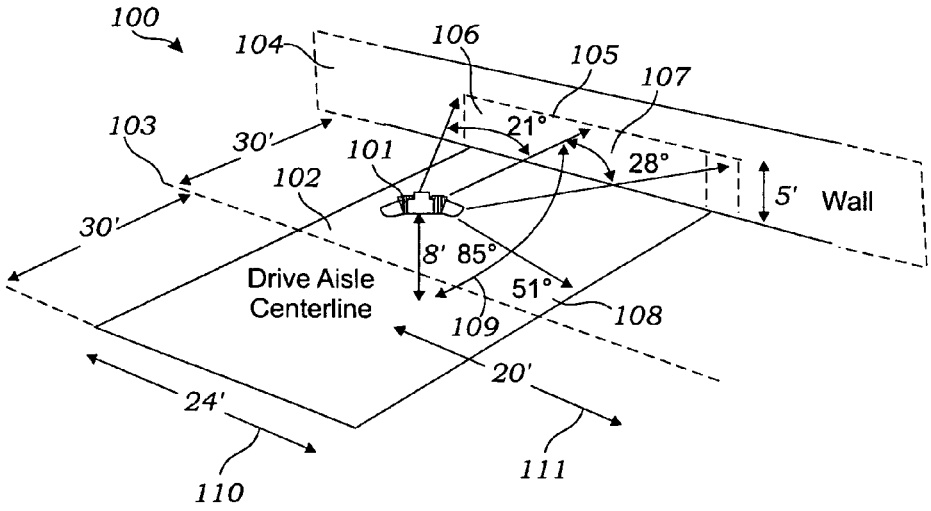
FIG. 6 is a schematic diagram illustrating the light distribution for an alternative exemplary reflector of the invention.

By way of still further example, FIG. 6 illustrates a parking garage application generally denoted 100 with the lighting module assembled into a luminaire 101 and projecting light as previously described. Here, a footprint 102 is illuminated by the luminaire 101 extending approximately 24 feet in width 110 and having a length of 60-feet denoted by a drive aisle centerline 103 at 30 feet. The footprint 102 abuts a wall 104 onto which light is projected along a pattern 105 that is roughly 5 feet tall. The horizontal coverage area is seen on one side of the schematic to have a 21-degree horizontal angle 106 and on the opposite side to have a 28-degree horizontal angle 107. This illustration does clarify the previous description of the 28-degree beam having a 7-degree overlap with the lighting projection by an adjacent luminaire installed on 20-foot spacing 111, and those skilled in the art will understand that both left and right sides have an equal beam pattern of the wider angle, in this example 28 degrees.

FIG. 6 also illustrates the vertical beam angles required to reach the sides 108 of the illumination pattern and also illustrates the vertical beam angle 109 required of the forward projection. These vertical angles are based on an 8-foot mounting height. Once more, it will be appreciated by those skilled in the art that this and the other applications in which the exemplary reflector unit of the present invention are merely for illustration and that a virtually infinite number of lighting patterns may be achieved depending on the location and orientation of the luminaire and/or the configuration of the reflector assembly as described above. Accordingly, the invention is not so limited.

Turning now to FIGS. 7-11, there is shown a unique method of manufacturing such a light shaping reflector system of the present invention, which method yields numerous further advantages in conjunction with the design of the reflector itself so as to provide the necessary functionality that is to be achieved even in the context of specific applications, yet without the need for expensive tooling or large quantity production runs.

Figure 7:
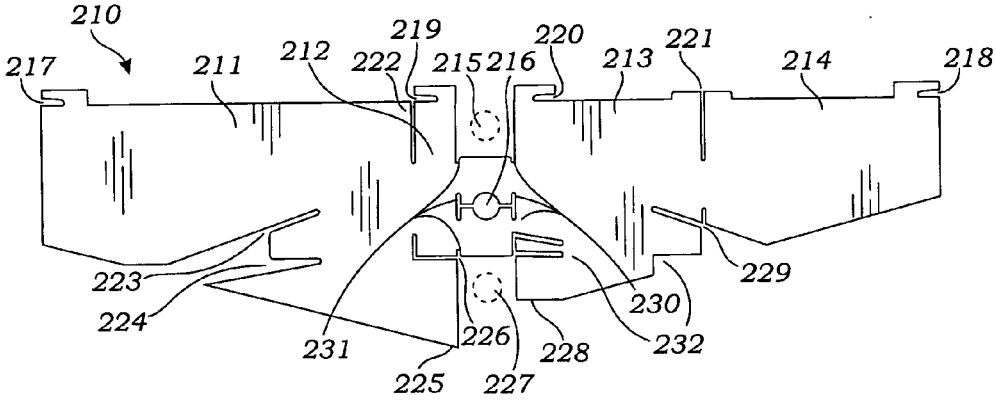
FIG. 7 is a top view of a cutout of an exemplary reflector body to be formed from flat reflective sheeting.

First, FIG. 7 illustrates a main reflector body 210 having been cut from flat reflective sheeting. It will be appreciated by those skilled in the art that any sheet material having adequate reflective properties for lighting applications, whether now known or later developed, may be employed in the present invention. Such material should also be relatively workable and able to be cut into the desired configuration using laser-, water-jet, die- or other such cutting techniques now known or later developed in the art. Depending on the application, those skilled in the art will further appreciate that the selected material may also need to have certain other properties relating to mechanical integrity, impact strength, and resistance to the elements in the case of an outdoor application, for example. Such sheet material may thus include flat metal or poly that is preferably greater than 98% reflective. Once the main reflector body 210 is cut out in the configuration shown, it will be bent in four places as it is pressed onto a forming tool to form the reflector body 250, as described more fully below in connection with FIGS. 8 and 9.

With continued reference to FIG. 7, the reflector body 210 is attached with a screw or other fastener between an upper LED aperture 215 and a lower LED aperture 227 to the mounting hole 216, which will serve as a base and fixed reference point for the subsequent forming operations. More specifically, the body 210 will be bent on a bend-line 231 on the left at about 20 degrees so as to form a first reflective sidewall 212 on the left that will hold a 20-degree angle to the next bend-lines 222, 226 where a second or forward reflective sidewall 211 will have 0 degrees, or be perpendicular to the base of the mounting hole 216. Similarly, the body 210 will be bent along bend-line 230 on the right at 20 degrees so as to form an opposite first reflective sidewall 213 on the right that will hold 20 degrees to the next bend-line 221 on the right where a second reflective sidewall 214 will have 8 degrees relative to the base with the mounting hole 216. Tabs 217, 218, 219, 220 will be turned substantially forward under which a top reflector (not shown) will be held captive, as described below in connection with the reflector assembly 270 of FIG. 11. It will be appreciated that bend-line 226 allows a complex bend and will keep tab 225 in the same plane as sidewall 211 to enhance "street side" illumination in the exemplary streetlight context, as explained below in connection with FIGS. 12-14. As above regarding other exemplary reflector designs, those skilled in the art will appreciate that the particular configuration of the flat reflector body 210 shown is merely exemplary and that numerous other configurations may be employed without departing from the spirit and scope of the invention.

Also shown in FIG. 7 are the guide slots 223, 224, 229 and 232 for horizontal reflector vanes that will be installed in a subsequent assembly step, as shown and described below in connection with FIG. 10. Guide slot 223 and slot 229 are aligned parallel after the reflector is formed and are configured in the exemplary embodiment to cooperate in accepting a horizontal reflector vane for the upper LED 215. Similarly, guide slot 224 on the left aligns with notch 232 on the right side to accept a reflector vane for the lower LED 227. As such, it will be appreciated that "house side" cut-off by the finished reflector assembly is accomplished by the resulting vane 225 being lower than the "street side" vane 228, as illustrated schematically by the ray tracing of FIG. 12 showing that rays will emit beneath the vane 228.

Figure 8:
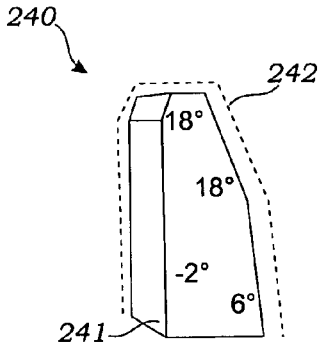
FIG. 8 is a perspective view of a body forming tool for shaping the flat part of FIG. 7 into a three-dimensional part.

Turning now to FIG. 8, there is shown a form 240 beneath an outline of a shaped part 242. The forming tool 241 is a fixed shape of wood, plastic or other non-abrasive material and may be slightly undersized as required for a particular reflective sheeting material to cause slight over-bending when forming the described angles, so as to overcome any tendency of the sheeting to spring back. The flat reflector body 210 is simply pressed down and in fully onto the forming tool 241 and the resultant shape is a three-dimensional part ready for insertion of the remaining components as described below. It will be appreciated that particular flat reflective materials used can have different bend characteristics and each may need different over-bend amounts, however, excessive over-bend will naturally be compensated for during assembly of the internal vanes and top reflector. It should also be noted that any manually implemented forming method illustrated in FIG. 8 is not to limit the scope of the present invention, and that many means for bending or forming such materials now known or later developed, whether manual or automated or some combination thereof, is possible without departing from the spirit and scope of the invention.

Figure 9:
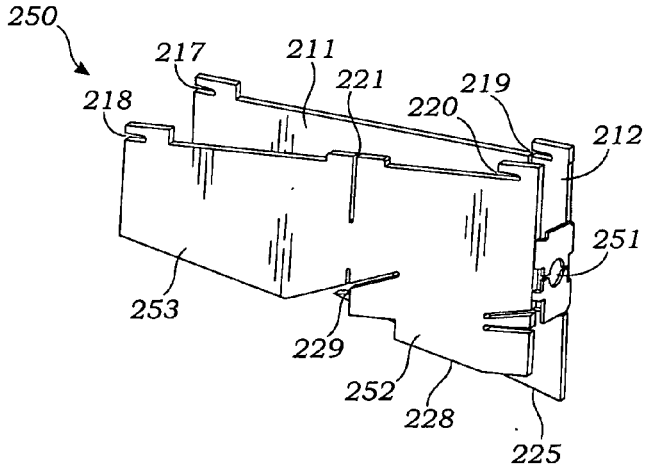
FIG. 9 is a perspective view of an exemplary reflector body formed from the flat part of FIG. 7 using the tool of FIG. 8.

Referring now to FIG. 9, there is shown a left rear perspective view of the formed reflector body 250 that illustrates the forward direction of tabs 217, 218, 219, 220 for securing the reflector top (not shown). In the exemplary embodiment, tab 217 and tab 218 will be turned or bent outward after insertion of the top assembly (not shown) to lock and retain the upper reflector. Also visible in this view are the rear flange mounting hole 251 and the outside surfaces 252, 253 of the right sidewalls 213, 214 (FIG. 7). It will be appreciated that retaining the reflectors in place by the bending of integral tabs may require a metal or such rigid, workable material, while with poly type reflective sheeting materials such as polycarbonate, mylars or acrylics, these tabs may be solvent bonded, ultrasonically welded or otherwise mechanically attached during assembly in any manner now known or later developed in the art. As seen in FIG. 3, vane 225 can be bent farther out with a wider angle if formed by the body forming tool 241 and therefore send more light to the "street side" center area, whereas those skilled in the art will readily appreciate that numerous optical adjustments are possible with the forming tool within the spirit and scope of the invention.

Figure 10:
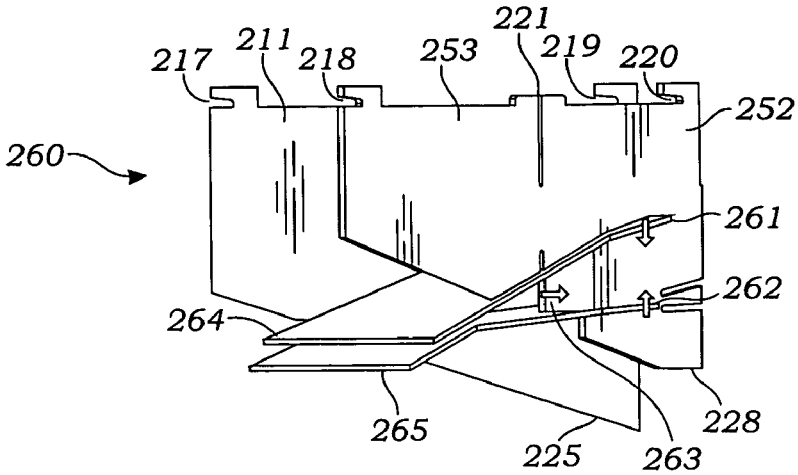
FIG. 10 is a perspective view of the exemplary reflector body of FIG. 9 now having horizontal vanes installed therein.

In FIG. 10 there is shown the reflector body 260 (250 in FIG. 9) now with a substantially horizontally oriented upper intermediate vane 264 for the upper LED 215 (FIG. 7) and a substantially horizontally oriented lower intermediate vane 265 for the lower LED 216 (FIG. 7). In this step of the exemplary reflector assembly process, a retaining and locking method is disclosed wherein tabs 261, 262, 263 are employed at each reflector body after the assembly is complete to secure the vanes 264, 265 without the need of additional fasteners. Those skilled in the art will appreciate that a single LED assembly is shown for simplicity and that a further embodiment involving a plurality of LED assemblies is illustrated in the alternative exemplary embodiment of FIG. 11. Accordingly, it will be further appreciated that any number and arrangement of LED assemblies are possible within a reflector system designed and fabricated according to the present invention.

Figure 11:
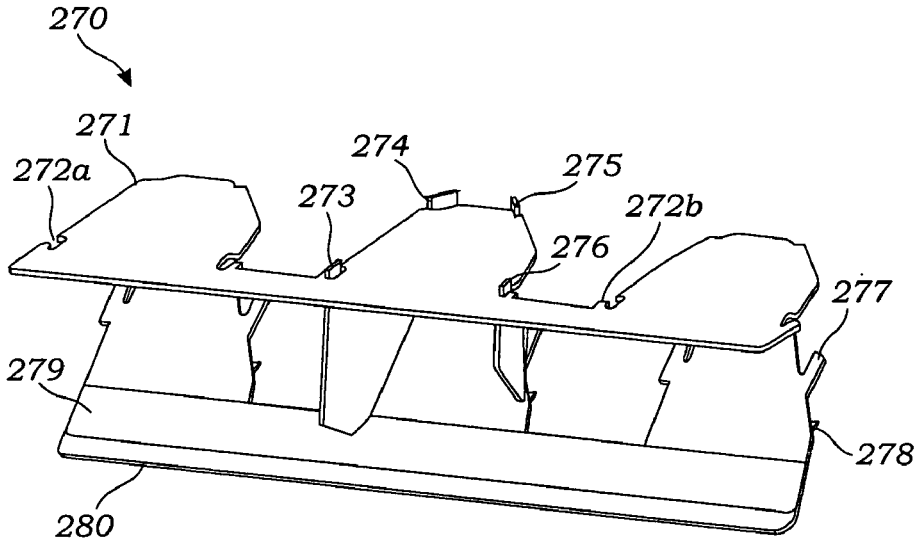
FIG. 11 is a perspective view of a plurality of alternative exemplary reflector bodies with vanes installed therein.

Turning to FIG. 11, there is shown an alternative exemplary embodiment reflector body 270 positioned among three LED assemblies, with the top reflector 271 secured in place beneath tabs 273, 274, 275, 276 on a central main reflector body. It will be appreciated that each pair of tabs 272*a*, 272*b* on the reflector top 271 bends upward to latch beneath respective tabs 273, 276 on each reflector body, and further that tabs 273, 276 each bend outward to retain the top reflector 271. In the exemplary embodiment of FIG. 11, the vane 279 for the upper LED 215 (FIG. 7) and the vane 280 for the lower LED 216 (FIG. 7) are shown in place as a common assembly for the plurality of LED main reflector bodies. In FIG. 11 it is further illustrated that the horizontal vane tabs 277, 278 both bend together for retaining the respective vanes 279, 280 on the reflector body 270. While in the exemplary embodiment shown in FIG. 11 the assembly comprises a plurality of LED reflectors sharing common reflector vanes and a common top reflector, it will be appreciated by those skilled in the art that in practice with particular applications more or less reflector sites may be employed without departing from the spirit and scope of the invention.

In FIG. 12, there is shown a top schematic diagram of optical ray tracing as from a reflector such as disclosed and described in connection with FIGS. 10 and 11 in order to illustrate mixing of wide angle light rays with narrow angle light rays and also to illustrate the "street side" light path. Those skilled in the art will appreciate that many reflector angles are possible for many illumination patterns and that the actual output footprint 292 (FIG. 14) depends also on the absolute angle of the lighting module 291 (FIG. 14) itself relative to the target. Accordingly, it will be appreciated that numerous alternative embodiments can be devised by those skilled in the art consistent with the teachings of this disclosure and so are to be understood to be within the scope of the system and method of the present invention.

Turning to FIG. 13, there is shown a side schematic diagram illustrating the optical ray tracing of the alternative exemplary reflector of FIG. 12 in which at least two LEDs are employed; in the exemplary embodiment an upper LED and a lower LED. As with the ray trace shown in FIG. 12, that of FIG. 13 is to be understood as merely illustrative of the mixing of wide angle light rays with narrow angle light rays to produce a relatively greater total target luminance at the desired angle or distance.

Referring finally to FIG. 14, there is shown a streetlight application generally denoted 290 with an exemplary lighting module of the present invention assembled within a luminaire 291, whereby light rays 293, 295 extend longitudinally and rays 294, 296 extend in the transverse direction. In this alternative exemplary embodiment, the target footprint 292 represents an outline of the ground or pavement illumination pattern. Those skilled in the art will appreciate the relationship between the ray tracing schematics and the outline and will further appreciate the correlation to the pre-defined illumination pattern determined by the reflector configuration and shape as described above. As such, it will be appreciated that numerous variations on the general principles of design and construction of the light shaping reflector system and method of the present invention are possible without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A light shaping reflector system comprising:

at least one reflector body having two side vanes formed about a top vane and about at least one intermediate vane, the two side vanes and the top and intermediate vanes having inwardly facing reflective surfaces, the top vane and the at least one intermediate vane each being positioned in a nominally horizontal plane, and the side vanes each being positioned in a nominally vertical plane, the side vanes comprising:

a single, fiat sheet having a mounting hole configured to be attached to a forming tool for bending the sheet to form the side vanes; the sheet-is bent along a first left bend-line at approximately twenty degrees (20°) relative to the mounting hole so as to form a first left reflective sidewall; the sheet bent along one or more second left bend-lines so as to form a second left reflective sidewall at approximately negative twenty degrees (−20°) relative to the first left reflective sidewall, the second left reflective sidewall is positioned substantially parallel to an axis of the mounting hole; the sheet bent along a first right bend-line at approximately twenty degrees (20°) relative to the mounting hole so as to form a first right reflective sidewall; and the sheet bent along one or more second right bend-lines so as to form a second right reflective sidewall at approximately negative twelve degrees (−12°) relative to the first right reflective sidewall, the second right reflective sidewall is positioned at an angle of approximately eight degrees (8°) relative to the axis of the mounting hole; and at least one LED positioned within the reflector body substantially between the side vanes and substantially between the top vane and the at least one intermediate vane;

whereby light emitted from the LED is cutoff downwardly by the intermediate vane and upwardly by the top vane and is directed off of the reflective surfaces of at least the top and intermediate vanes so as to collimate at least a portion of the light toward a far field target at substantially zero degrees relative to the optical axis of the LED, and whereby light emitted from the LED is cutoff laterally by the two side vanes and is directed off the reflective surfaces of the side vanes so as to concentrate the light in a substantially cone projection and amplify total luminance of the target.

2. The reflector system of claim 1 wherein the sheet is greater than ninety-eight percent (98%) reflective.

3. A light shaping reflector system comprising:

at least one reflector body having two side vanes formed about a top vane and about an upper intermediate vane and a lower intermediate vane spaced apart from the upper intermediate vane, the top vane and the upper intermediate vane each being positioned in a nominally horizontal plane and the side vanes each being positioned in a nominally vertical plane, with an upper cutout being formed in the reflector body between the side vanes and between the top vane and the upper intermediate vane and a lower cutout being formed in the reflector body between the side vanes and beneath the lower intermediate vane, the vanes each having inwardly-facing reflective surfaces; and an upper LED positioned within the upper cutout of the reflector body and a lower LED positioned within the lower cutout of the reflector body, whereby light emitted from the upper LED is cutoff downwardly by the upper intermediate vane and upwardly by the top vane, light emitted from the lower LED is cutoff upwardly by the lower intermediate vane, and light emitted from both the upper and lower LEDs is cutoff laterally by the two side vanes, such that the light is directed off the reflective surfaces of the top vane, the upper and lower intermediate vanes, and the two side vanes so as to collimate at least a portion of the light toward a far field target at substantially zero degrees relative to the optical axis of both the upper and lower LEDs and concentrate the light in a substantially cone projection and amplify total luminance of the target.

4. The reflector system of claim 3 wherein each side vane further comprises an extended forward vane for relatively sharper lateral cutoff of the emitted light.

5. The reflector system of claim 3 wherein the top vane is formed with at least one uplight slot for uplight illumination.

6. The reflector system of claim 3 wherein the cone projection has an angle ranging from forty degrees (40°) to forty-five degrees (45°).

7. The reflector system of claim 3 wherein the reflector body is formed with multiple bendable tabs for retaining the top vane.

8. The reflector system of claim 3 wherein the reflector body is formed with multiple guide slots for retaining the upper and lower intermediate vanes.

9. The reflector system of claim 3 further comprising two reflector bodies so as to form a luminaire unit with opposing sides of the unit each having at least one LED.

* * * * *